US010974927B2

(12) United States Patent
Lee

(10) Patent No.: US 10,974,927 B2
(45) **Date of Patent: *Apr. 13, 2021**

(54) SYSTEM AND METHOD FOR A POWERED VERTICAL AXIS HOSE REEL

(71) Applicant: Randal A. Lee, Marble Falls, TX (US)

(72) Inventor: Randal A. Lee, Marble Falls, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/681,570

(22) Filed: Nov. 12, 2019

(65) Prior Publication Data

US 2020/0079617 A1 Mar. 12, 2020

Related U.S. Application Data

(63) Continuation of application No. 15/809,824, filed on Nov. 10, 2017, now Pat. No. 10,472,202.

(60) Provisional application No. 62/420,018, filed on Nov. 10, 2016.

(51) Int. Cl.
*B65H 75/44* (2006.01)

(52) U.S. Cl.
CPC ..... *B65H 75/4484* (2013.01); *B65H 75/4463* (2013.01); *B65H 75/4471* (2013.01); *B65H 75/4478* (2013.01); *B65H 75/4486* (2013.01); *B65H 2701/33* (2013.01); *Y10T 137/6932* (2015.04); *Y10T 137/6954* (2015.04)

(58) Field of Classification Search
CPC ..... B65H 75/4463; B65H 75/4471; B65H 75/4484; B65H 75/4486; B65H 2701/33; Y10T 137/6932; Y10T 137/6954
See application file for complete search history.

(56) References Cited

U.S. PATENT DOCUMENTS

| | | | | |
|---|---|---|---|---|
| 4,757,838 | A ‡ | 7/1988 | McGullion | B65H 75/38 137/355.27 |
| 5,495,995 | A ‡ | 3/1996 | Dominique | B65H 75/38 242/390.1 |
| 6,382,241 | B1 ‡ | 5/2002 | Setrum | A47L 5/38 137/355.22 |
| 6,807,982 | B1 ‡ | 10/2004 | Ames | B65H 75/364 137/355.27 |
| 7,503,338 | B2 ‡ | 3/2009 | Harrington | A01G 25/162 137/355.16 |
| 7,931,225 | B2 ‡ | 4/2011 | Wang | B65H 75/4407 137/355.21 |
| 8,746,246 | B2 ‡ | 6/2014 | Lueckenhoff | A61M 16/0875 128/204.18 |
| 9,079,748 | B2 * | 7/2015 | Tracey | F16L 55/07 |
| 9,463,951 | B1 ‡ | 10/2016 | Davis, Jr. | B65H 75/34 |
| 10,472,202 | B2 * | 11/2019 | Lee | B65H 75/4471 |

(Continued)

*Primary Examiner* — Kevin F Murphy

(74) *Attorney, Agent, or Firm* — Bell Nunnally & Martin LLP

(57) ABSTRACT

In accordance with the present invention, a system and method for a powered vertical axis hose reel is shown. In accordance with one aspect of the present invention, a powered hose reel is disclosed having a spool around which a hose may be coiled, in which the spool is on a vertical axis relative to the ground. In various embodiments, the powered hose reel includes a programmable controller for implementing a rewind protocol adapted to encourage the hose to fill from the bottom of the spool cup to the top.

20 Claims, 7 Drawing Sheets

(56) References Cited

U.S. PATENT DOCUMENTS

2005/0087644 A1‡ 4/2005 Kim ..... B65H 75/425
242/390.8

* cited by examiner
‡ imported from a related application

SYSTEM AND METHOD FOR A POWERED VERTICAL AXIS HOSE REEL

CROSS-REFERENCE TO RELATED APPLICATIONS

This patent application is a continuation of U.S. patent application Ser. No. 15/809,824, filed Nov. 10, 2017 entitled, "System and Method for a Powered Vertical Axis Hose Reel," which claims priority to claims priority to U.S. Provisional Patent Application Ser. No. 62/420,018, filed Nov. 10, 2016, and is incorporated herein by reference.

BACKGROUND

Technical Field

This invention relates in general to the field of powered hose reels, and more particularly, but not by way of limitation to systems and methods for a powered vertical axis hose reel.

Background

Hose reels are well known and widely available for many different functions. Particularly, hose reels, for spooling hoses, are often provided to facilitate the use and storage of hoses. Hoses, such as garden hoses, tubes, wires, cords, ropes, lines, and the like, can be cumbersome and difficult to manage. Mechanical reels have been designed to help spool hoses onto a drum-like apparatus. Some conventional reels are manually operated, requiring the user to physically rotate the reel, or drum, to spool the hose. This can be tiresome and time consuming for users, especially when the hose is of a substantial length. Other reels are motor-controlled, and can automatically wind up the hose. These automatic reels often have a gear assembly wherein multiple revolutions of the motor cause a single revolution of the reel. For example, some conventional automatic reels have a 30:1 gear reduction, wherein 30 revolutions of the motor result in one revolution of the reel.

However, when a user attempts to pull out the hose from the automatic reel, the user must pull against the increased resistance caused by the gear reduction because the motor spins 30 times for every full revolution of the reel. Not only does this place an extra physical burden on the user, but the hose experiences additional strain as well. Some automatic reels include a clutch system, such as a neutral position clutch, that neutralizes (or declutches) the motor to enable the user to freely pull out the hose. This often requires the user to be at the site of the reel to activate the clutch. In addition, clutch assemblies can be expensive and substantially increase the cost of automatic reels.

In hose reels having a horizontal axis, one problem that is encountered is that the hose tends to wrap around a single location on the axis, causing it to bunch up. In such embodiments, additional mechanics are needed to move the hose along the horizontal axis as it is wrapped around the hose reel. For example, reels for spooling hoses and similar materials onto a rotating drum have incorporated the reciprocating motion of a guide through which the hose passes to advantageously cause the hose to be wrapped substantially uniformly around most of the surface area of the drum. Several methods have been utilized in the past for achieving such reciprocating motion. One common approach is to use a rotating reversing screw which causes a guide to translate back and forth in front of a rotating drum. However, such reversing screws tend to wear out quickly, degrading reel performance and necessitating frequent replacement.

Another approach for producing reciprocating motion of the guide is to use a motor to control a rotating screw upon which the guide translates. In this class of reels, the motor reverses the direction of rotation of the screw whenever the guide reaches an end of the screw. Unfortunately, the repeated reversing of the motor increases the spooling time and causes the motor to wear down sooner. Other reels have incorporated significantly more complicated gear mechanisms for achieving the reciprocating motion. Many reel constructions include exposed moving parts, such as the reel drum, guide, and motor. Over time, such moving parts can become damaged due to exposure. For example, an outdoor reel is exposed to sunlight and rain. Such exposure can cause the moving parts of the reel to wear more rapidly, resulting in reduced performance quality.

SUMMARY OF THE INVENTION

In accordance with the present invention, a system and method for a powered vertical axis hose reel is shown. In accordance with one aspect of the present invention, a powered hose reel is disclosed having a spool around which a hose may be coiled, in which the spool is on a vertical axis relative to the ground. In various embodiments, the powered hose reel includes a programmable controller for implementing a rewind protocol configured to encourage the hose to fill from the bottom of the spool cup to the top. Various embodiments include a method of operating a vertical axis hose reel.

The above summary of the invention is not intended to represent each embodiment or every aspect of the present invention. Particular embodiments may include one, some, or none of the listed advantages.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION

Figure 1:
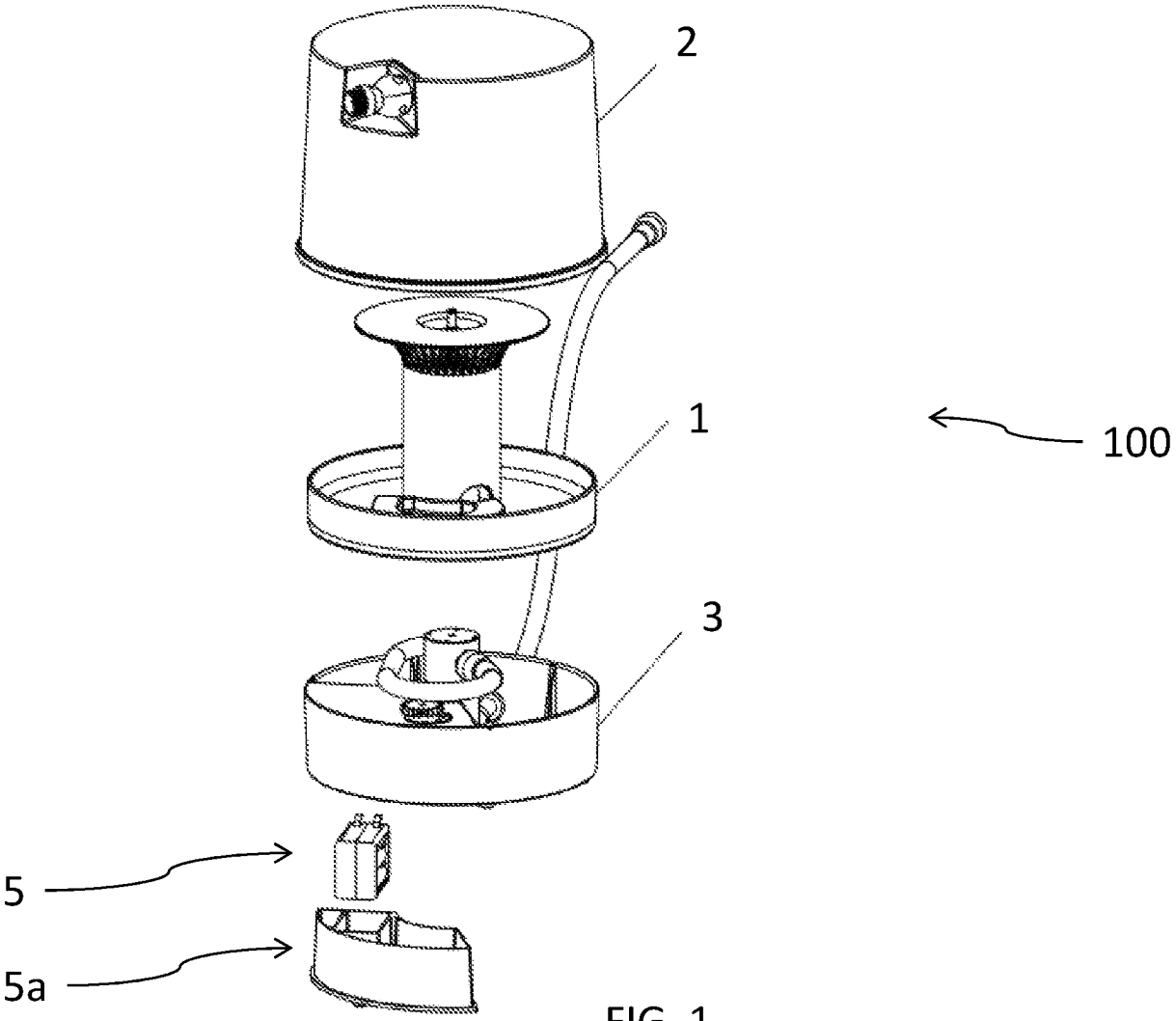
FIG. 1 illustrates an exploded view of a vertical axis hose reel of one embodiment of the present invention.
Figure 2B:
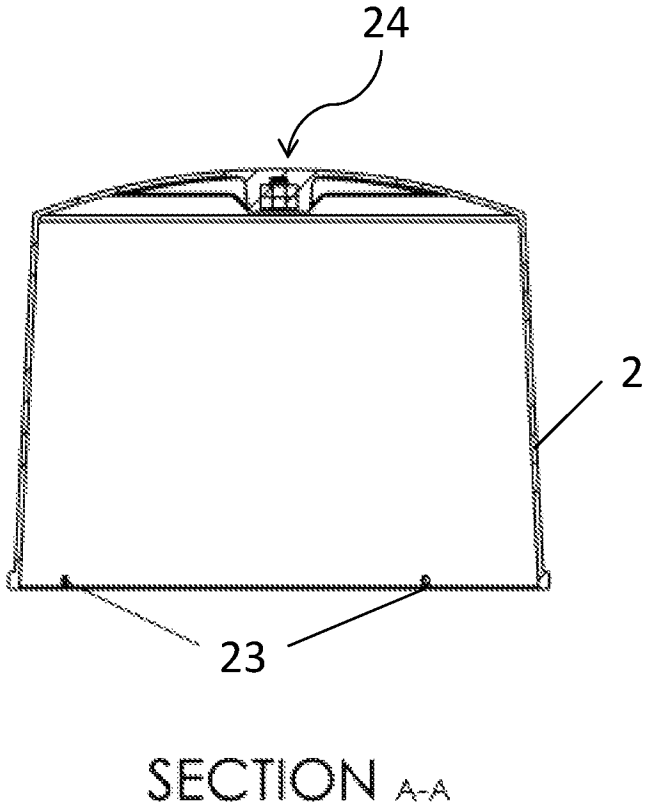
FIG. 2*b* illustrates a side cut-away view of the cover top of FIG. 2*a;*
Figure 2A:
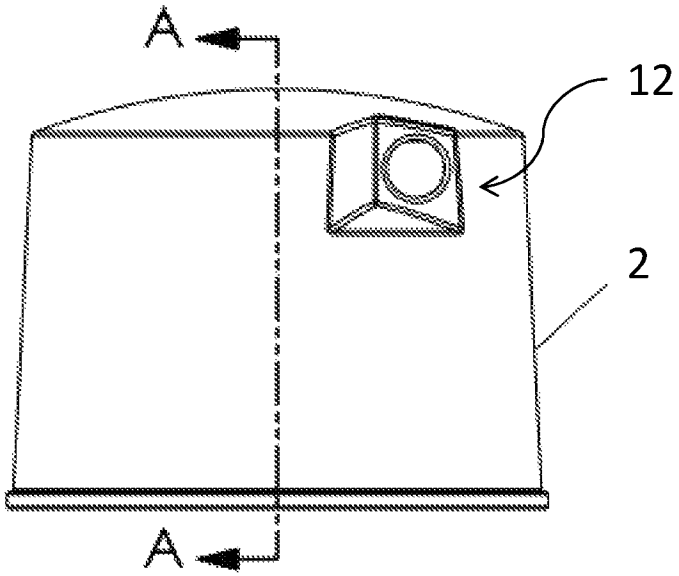
FIG. 2*a* illustrates a cover top of the hose reel of FIG. 1.

FIG. 1 shows an exploded view of a powered vertical axis hose reel 100 according to an embodiment of the present invention. The hose reel 100 may be used to wind and unwind hoses, such as, for example, rubber garden hoses, woven jacket hoses, wires, cords, lines, ropes, straps, or similar materials. In the embodiment shown, the hose reel 100 includes a cover top 2 over a spool 1 mounted to a base 3. In the embodiment shown, the hose reel 100 is powered by a battery 5, which is contained in a battery holder 5*a* inserted into the base 3. Turning now to FIG. 2*a*, an embodiment of a cover top 2 for providing protection from the elements, such as rain and sun, for a hose wound around a spool 1 within a hose reel 100. The cover top 2 may be generally cylindrical having a closed upper end and an open lower end and may be formed of plastic and held in place via a central shaft or tie rod (not shown). As described in more detail below, the cover top 2 may be piloted at the bottom by a close clearance fit to the spool 1. The cover top 2 includes an eyelet 12 for the hose (not shown) to pass through. The dimensions of the eyelet 12 may be varied to control the way the hose will coil in the cup of the spool. The angle, diameter, and length of the bore of the eyelet 12 may be modified depending on the characteristics of the hose or other material being wound by the hose reel 100. In some embodiments, the eyelet 12 may be modifiable, for example, by twisting, sliding, turning, etc. to vary the length, diameter, and/or angle of the bore depending on desired performance and/or characteristics of the hose being wound. In other embodiments, the cover top 2 and/or the eyelet 12 may be swapped out with a cover top and/or eyelet having different characteristics. As can be seen in FIG. 2*b*, in some embodiments, the cover top 2 may include one or more magnets 23 around a bottom edge or lower portion thereof to facilitate securement of the cover top 2 to the base and/or provide a way for sensors on the base to monitor the orientation, motion, and/or rotation of the cover top 2 relative to the base 3. In various embodiments, the cover top 2 can rotate 360 degrees freely around a central shaft with a bushing or bearing 24 located at or near the upper surface of the cover top 2. In some embodiments, the cover top 2 may be screwed onto the central shaft and/or the shaft may pass through an aperture in an upper surface of the cover top 2 and an external knob or nut may be screwed or otherwise secured to the shaft.

Figure 3:
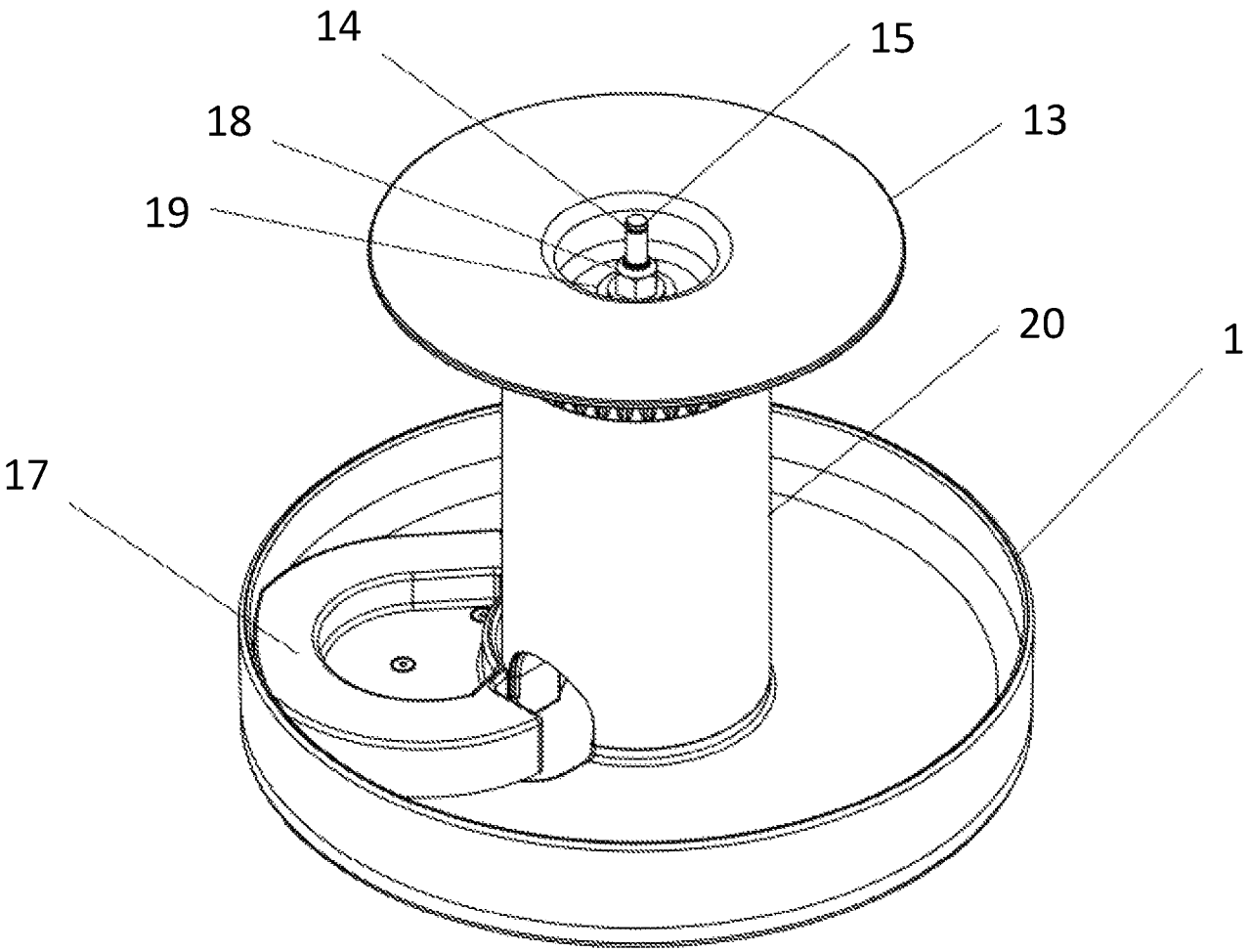
FIG. 3 illustrates a top perspective view of a spool of the hose reel of FIG. 1.

Referring now to FIG. 3, a perspective view of a spool 1 is shown. In various embodiments, the spool 1 may be formed from molded plastic and may be cup shaped on a lower portion thereof with a relatively large spool arbor 20 extending upwardly therefrom. In some embodiments, the spool 1 may be a multi-piece assembly comprised of a plastic cap mounted on a steel mandrel. In various embodiments, the spool arbor 20 may be modified and/or swapped out to accommodate various characteristics of different hoses, such as larger diameter hoses, stiffer hoses, etc. In some embodiments, the spool arbor 20 may be made of plastic, steel, metal, composite, or other material and may be capable of withstanding the pressurization of a hose even when such hose is tightly wound around the spool arbor 20. In some embodiments, the spool 1 may include a deflector 13 at an upper end of the spool arbor 20. The spool arbor 20 may include a tie rod 15, a socket 18, and a washer 19. On a lower surface of the spool 1, some embodiments may include a hose clamp 17 to secure an end of a hose (not shown) in place. In various embodiments, the spool 1 may have a ring gear 16 (not shown) on a top surface thereof, bottom surface thereof, or both. The ring gear 16 may be molded into the top or bottom surface or may be attached to the top or bottom surface. The ring gear 16 may include gear teeth which may be driven using, for example, a DC brushless motor. In some embodiments, the gear teeth may face inwardly towards the spool arbor 20 or may face outwardly towards a peripheral edge of the spool 1. In some embodiments, the gear teeth may be disposed within a recess on the bottom surface of the spool 1. In other embodiments, the gear teeth may be disposed around the outer surface of the spool along an upper or lower peripheral edge thereof and/or extending the entire length of the outer surface and may face inwardly or outwardly. In various embodiments, the motor may include one or more gears configured to matingly engage the gear teeth to control rotation of the spool 1. In other embodiments, the motor may be coupled to the spool 1 via a belt or drive chain. In some embodiments, the motor may be disposed on the base 3 whereas in other embodiments, the motor may be disposed on the spool 1 and the gear teeth may be disposed on the base 3. One or more bushings or bearings may be disposed in the cover top 2 and/or may be disposed on an upper edge of the tie rod 15 to allow the cover top 2 to rotate around the tie rod 15. In the embodiment shown, the tie rod 15 has a c-clip 14 snapped into a groove on an upper portion thereof to provide a "snap" fit with the cover top 2.

Figure 4:
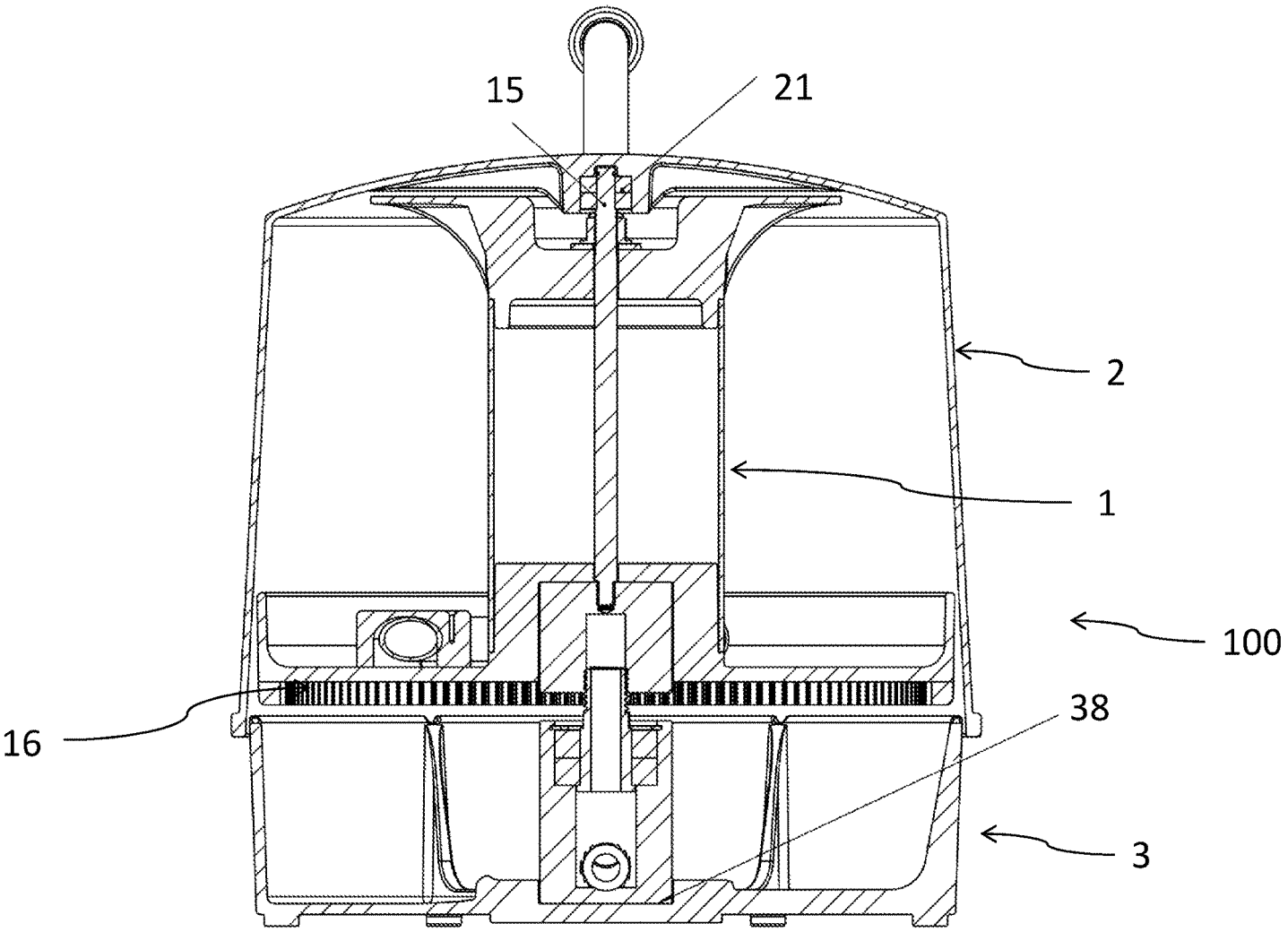
FIG. 4 illustrates a side cut-away view of an assembled hose reel.

FIG. 4 shows a side cutaway view of a powered vertical axis hose reel 100. In some embodiments, the spool arbor of the spool 1 have a relatively straight spool surface or may include a tapered spool surface, which may be larger at the top or may be narrower at the top. In such embodiments, the tapering of the spool arbor 20 may help encourage the hose to fill from the bottom of the spool cup to the top. In various embodiments, the tapering of the spool surface may be integral to the spool 1 or may be created via an assembly added to the spool arbor 20. In various embodiments, utilizing the tapering of the spool surface may allow for a faster rewind, requiring less reversing of the DC motor, as explained in more detail below. As can been seen from the cut-away view, the powered hose reel 100 includes a tie rod 15 coupled to a bearing 21 located near a top portion thereof and coupled to a rotary union 38 at the other end thereof. As can be seen, the lower cup-shaped portion of the spool 1 has a ring gear 16 molded into the bottom or attached to the bottom thereof. In some embodiments, the ring gear 16 is molded into the base of the spool 1 and may be driven by motor, such as a high torque DC gear-motor (not shown). The DC motor may have a spur gear on its shaft to matingly engage the ring gear 16. The motor controller may be a full-bridge controller using firmware to allow for efficient forward and reversing motions.

Figure 5:
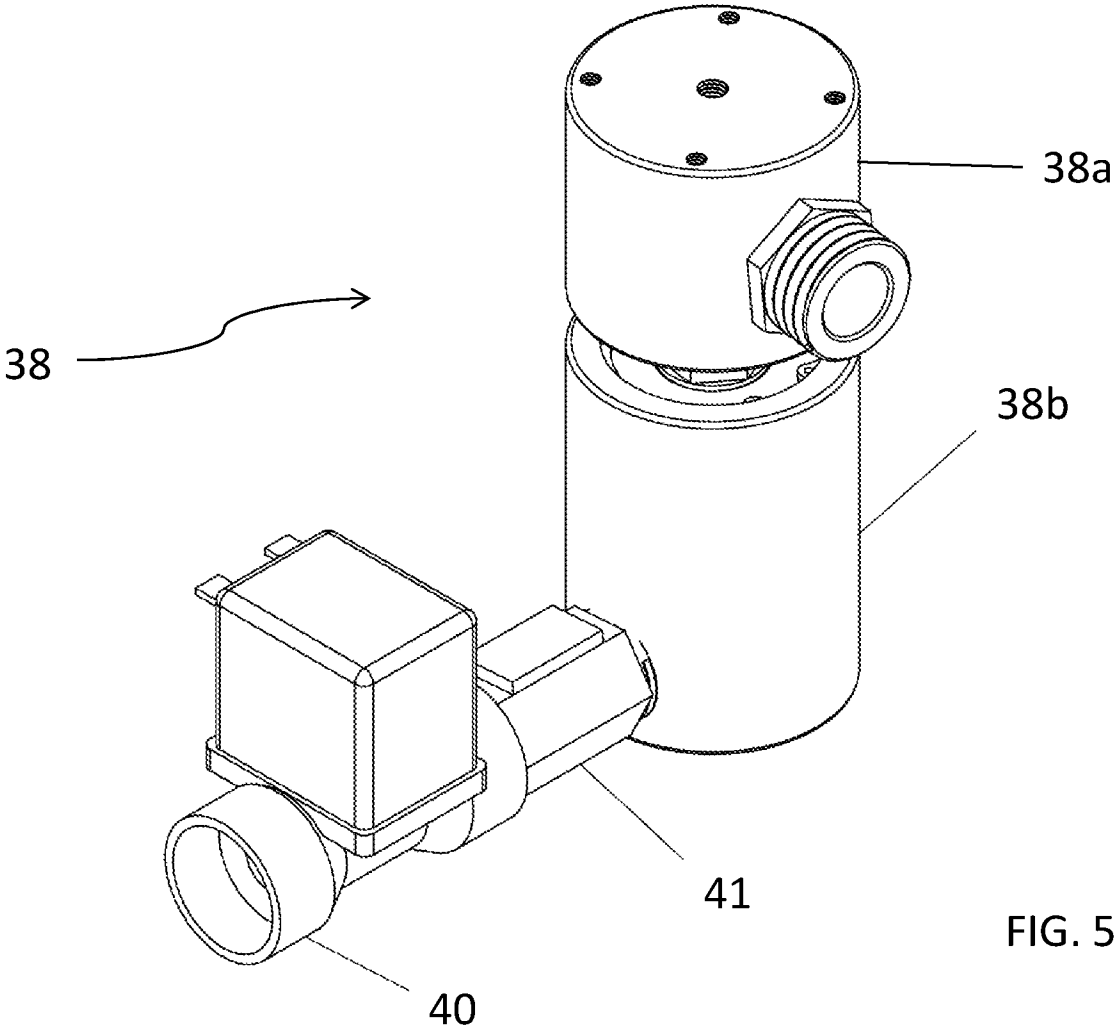
FIG. 5 illustrates a rotary union of the hose reel of FIG. 1.

FIG. 5 shows a perspective view of an embodiment of a rotary union 38. In various embodiments, the rotary union 38 may be metal and may be used to create a fluid connection between the hose being wound or unwound around the rotating spool 1 and the stationary supply hose 39 (not shown) coupled to a source of water or other fluid. The tie rod 15 may be coupled to an upper surface of the rotary union 38 allowing an upper portion 38*a* of the rotary union 38 to be coupled to the spool 1 to rotate while a lower portion 38*b* of the rotary union 38 remains stationary. The upper portion 38*a* may have a hose coupling in fluid communication with a hose being wound around the spool 1. In some embodiments, the hose being wound around the spool 1 may be passed through the hose clamp 17 and coupled directly to the hose coupling or may be indirectly coupled thereto, such as, for example, via a relatively short intermediate hose disposed within the hose clamp 17. The lower portion 38*b* may have a hose coupling in fluid communication with a stationary supply hose 39 coupled to a source of water or other fluid. In some embodiments, the stationary supply hose 39 may be coupled directly to the hose coupling or may be indirectly coupled thereto, such as, for example, via a relatively short intermediate hose disposed within the base 3. In some embodiments, the rotary union 38 may have a solenoid 41 disposed near an intake thereof to control the flow of water or other fluid therethrough. In some embodiments, the rotary union 38 may also include a flow meter 40 to monitor an amount of fluid flowing therethrough. The rotary union 38 may have a low pressure drop design to ensure a flexible hose does not collapse during use. The rotary union 38 may be used to convey water or other fluid and may include, for example, spring-loaded silicon carbide seals engineered for long use, such as, for example, thousands or millions of rotations, while remaining relatively leak free. In some embodiments, the rotary union 38 may be rated for use in a broad range of temperatures, such as, for example, for use in below freezing temperatures and/or in above 180 degree C. temperatures. While the embodiment shown uses a rotary union 38, other embodiments may utilize a plurality of swivels, O-rings, or other connections allowing rotation of the axis while allowing fluid flow therethrough.

Figure 6:
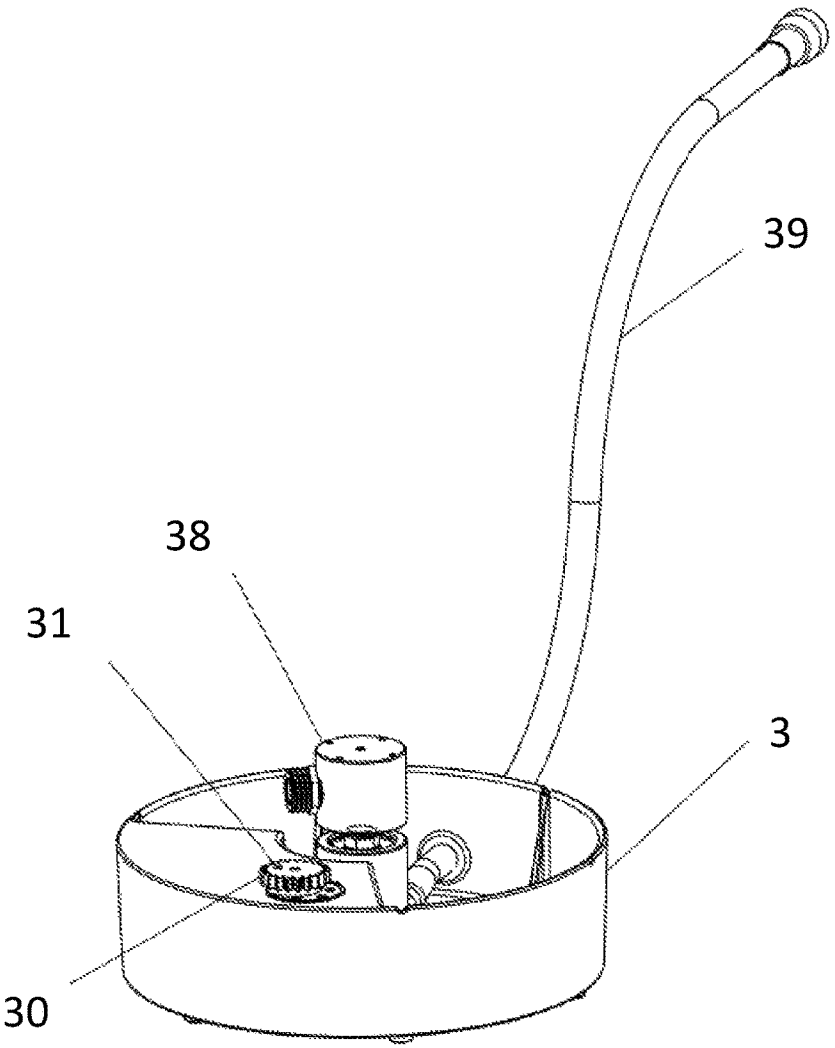
FIG. 6 illustrates a base of the hose reel of FIG. 1.

FIG. 6 shows a perspective view of a base 3 of the vertical axis hose reel 100. The base 3 may be formed of molded plastic or other material and may be configured to couple a supply hose 39 to the rotary union 38. In various embodiments, the base 3 may house a DC motor (not shown), drive electronics (not shown), a battery 5 (not shown), the rotary union 38, the flow meter 40, and the shut-off valve or solenoid 41 (not shown). In some embodiments, the motor may be a 20 watt 24 VDC motor to facilitate the winding and unwinding of the hose at average speed of, for example, 0.5 m/sec. In some embodiments, the battery 5 may include a 2.0 Amp-hour rechargeable Li-ion battery pack capable of powering, for example, approximately 200 rewinds between charges. In some embodiments, the motor may be coupled to a gear 30, such as a pinion or spur gear, configured to matingly engage the gear teeth of the ring gear 16 of the spool 1. In some embodiments, the pinion or spur gear 30 may include one or more magnets 31 thereon. In some embodiments, sensors, such as hall sensors, may be used to sense the revolutions of the magnet(s) 31 in the pinion or spur gear 30 and the magnet(s) 23 in the cover top 2. The drive electronics may be configured to determine the rate of hose extension or retraction. The drive electronics may include one or more accelerometers and/or gyros to allow a determination of a tilt of the hose reel 100 or an impulse, such as from a user kicking the hose reel 100 or yanking on the hose, that may be used as a signal to rewind the hose, allow more hose to be unwound, or power assist the unwinding of the hose. These telemetries may also be used to determine if the hose is snagged, if the rewind has been completed, and/or other operational state information. In some embodiments, a hall probe may sense the motion of the magnet(s) 23 in the cover top 2 in order to determine the revolutions of the cover top 2. For example, if the cover top 2 is rotating at the same speed as the spool 1, the hose may be fully retracted and the rewind may cease.

Figure 7:
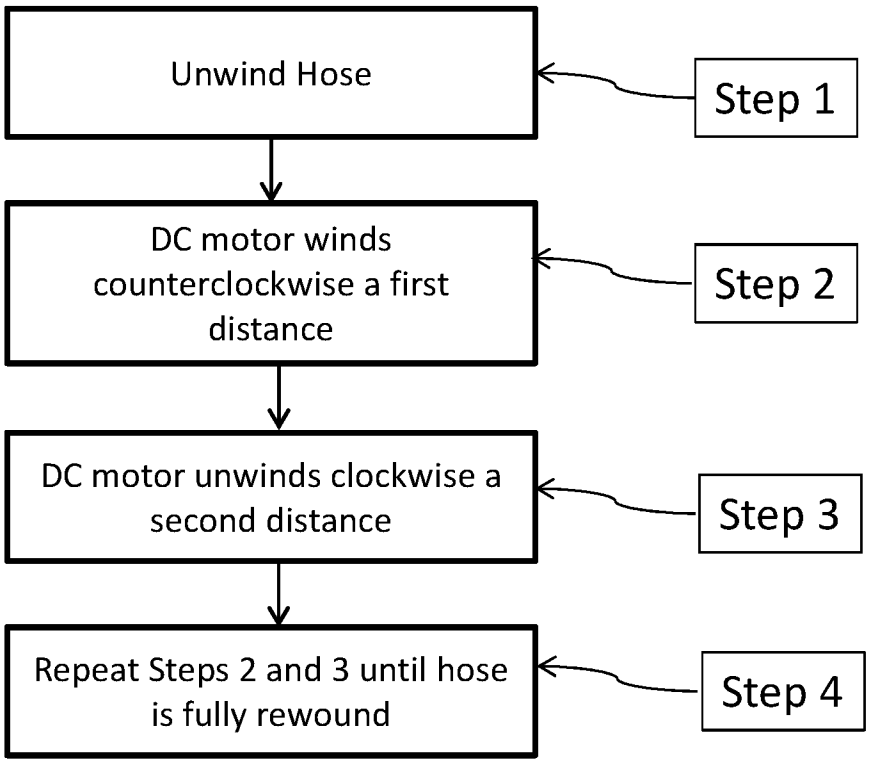
FIG. 7 is a flow chart of a method of operation of a powered vertical axis hose reel according to an embodiment.

FIG. 7 is a flowchart showing a method of using a powered vertical axis hose reel 100. Beginning at step one, a user may manually unwind a hose that has been wound around the spool by pulling the hose outwardly through the eyelet of the top cover. In various embodiments, the hose reel 100 may be capable of 360 degrees of rotation to allow uninterrupted unwinding of the hose or other material wound around the spool. In some embodiments, the hose reel may "power assist" the unwinding of the hose, may engage a clutch or otherwise disengage the gear to allow the spool to spin freely, and/or may utilize some of the energy from unwinding the hose to recharge the battery. At step two, the DC motor is activated to rotate the spool in a first direction, such as counterclockwise, a first distance, such as for example, between 45 degrees and 450 degrees in a smooth rewind. In some embodiments, the motor may be activated to begin the rewind process in any of a number of ways. For example, a controller may include a "kick-to-rewind" feature wherein onboard telemetry senses a kick, press, push, pull, yank, or other physical interaction and takes steps in response thereto, such as unwinding the hose, allowing additional hose to be unwound, and/or initiate a rewind protocol to facilitate a tangle free rewind. The hose reel 100 may include a wired or wireless interface, such as cellular, Wi-Fi, Bluetooth, or other connection. The wired or wireless interface may facilitate remote control of the winding and unwinding of the hose and/or control of the fluid flow therethrough using an interface, such as a control pad, remote control, an app on a smartphone, etc. The "kick-to-rewind" feature may leverage onboard telemetries to reduce product cost and improve reliability and user experience. The "kick-to-rewind" feature may eliminate the need for a switch or other control pad, which may be costly, unreliable, and/or difficult to reach.

At step three, the motor reverses direction for a second distance, typically less than the first distance, such as, for example, between approximately 45 degrees to 90 degrees, to allow gravity to pull the coil of hose to the bottom of the cup of the spool. The hose reel 100 may include software having a built-in rewind protocol to build slack into the coils in order to maintain a clearance between the hose and internal surfaces of the hose reel 100 and/or to allow for hose expansion when the hose is pressurized. For example, in embodiments without a tracking eyelet, if the rewind is done at a continuous speed, the hose may tend to bunch up in one place of the spool. Tracking eyelets often course back and forth along the axis of rotation to distribute the hose on the spool evenly. However, tracking eyelet mechanisms are typically expensive and/or unreliable, and thus, may be optionally excluded in some embodiments. In some embodiments, to avoid bunching on rewind, the DC motor rewinds the hose onto the spool some number of turns or fractions of a turn, driven by the hose mechanical properties. In some embodiments, such as when winding a typical woven jacket hose, the spool may be rotated 720 degrees in one direction, and then rotated in a reverse direction for a number of turns or fractions of a turn, such as, for example, 360 degrees, allowing gravity to pull the coils of hose to the bottom of the cup of the vertical axis spool. At step four, the DC motor continues winding the spool in a counterclockwise direction. Steps two and three are repeated until the hose is wound around the spool. This process may be repeated, repeating the wind and unwind protocol, until all the hose is wound onto the spool. Unlike horizontal axis spools, which wind hoses in a side-by-side manner, the vertical axis of the hose reel 100 winds the hose around the spool from the bottom to the top by allowing gravity, not hose tension, to "stack" the coils on the bottom of the spool. In some embodiments, such stacking may provide expansion space on top of the coils for when the hose is pressured and expands. Depending on the stiffness and bend radius of a hose to be re-wound, a different rewind protocol may be utilized. Different spool geometry may also be required to be compatible with hoses with different mechanical properties. As will be readily apparent, the first distance and second distance can be varied to facilitate a speedy and efficient coiling of the hose. In some embodiments, the ratio of the first distance to the second distance may be varied as the hose is being wrapped around the spool arbor 20. In various embodiments, the control circuitry may automatically vary the rewind protocol depending on the type of hose being wound and/or unwound, the ambient temperature, and/or the strain on the motor or other information. In some embodiments, a user may input one or more characteristics of the hose, such as, for example, the brand, type, material, length, stiffness, etc., which the control circuitry may use to select and/or vary the rewind protocol. In other embodiments, the user may manually adjust the rewind protocol. In various embodiments, the onboard telemetries may also sense and respond to hose snags and/or when the rewind of a hose has been completed.

In some embodiments, onboard sensors may monitor and send information, such as temperature and humidity information and/or volumetric flow data, to a remote location, such as to a smartphone via a smartphone app. In some embodiments, the hose reel 100 may be programmable and facilitate on/off control using, for example, the solenoid coupled to the rotary union. In other embodiments, the hose reel 100 may include a flow sensor to monitor and control the volumetric flow of fluid therethrough. In some embodiments, the hose reel 100 may include a freeze warning to alert a user to disconnect the hose or take other steps to prevent freezing and/or damage to the hose reel 100 and/or the hose wound therein. In other embodiments, the hose reel 100 may automatically allow a slow stream of water or other fluid to flow therethrough to prevent freezing and/or damage.

U.S. Pat. Nos. 7,503,338; 7,350,736; 8,695,912; and 8,746,605, which are hereby incorporated by reference in their entirety, disclose various details of powered hose reels that may be incorporated into various embodiments of the present invention, such as, for example, remote controls for controlling hose operation and protocols for varying the rewind speed of the hose being rewound.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention.

What is claimed is:

1. A motorized reel for spooling linear material around a vertical axis, the motorized reel comprising:

a base having a fluid inlet;

a spool having an upper end, a lower end, and an arbor therebetween, the lower end being rotatably mounted to the base and having an axis of rotation generally perpendicular to the base, the spool configured to wind a linear material around the arbor as the spool rotates in a first direction and to unwind the linear material from around the arbor as the spool rotates in a second direction;

a rotary union having a rotating portion coupled to the spool and a stationary portion secured to the based and in fluid communication with the fluid inlet;

a cover rotatably mounted to the upper end of the spool, the cover substantially surrounding the spool and having an eyelet therein to allow the linear material to pass therethrough;

a motor configured to interact with the spool to selectively rotate the spool in the first direction or in the second direction;

one or more sensors configured to detect rotation of the cover; and control circuitry in communication with the motor, the control circuitry configured to receive at least one signal from a remote control device and output a first control signal to cause the motor to rotate the spool.

2. The motorized reel of claim 1, wherein, to wind the linear material, the control circuitry alternates between outputting the first control signal to cause the motor to rotate the spool in the first direction and outputting a second control signal to cause the motor to rotate the spool in the second direction.

3. The motorized reel of claim 1, wherein the control circuitry is configured to send at least one signal to the remote control device.

4. The motorized reel of claim 1 wherein the one or more sensors are configured to detect rotation of the cover relative to the spool.

5. The motorized reel of claim 1 wherein the one or more sensors are configured to detect rotation of the cover relative to the base.

6. The motorized reel of claim 1 and further comprising:

at least one magnet coupled to the cover; and wherein the at least one of the one or more sensors is a Hall Effect sensor configured to detect rotation of the cover relative to the base.

7. An automated reel for spooling linear material around a vertical axis, the automated reel comprising:

a base;

a spool having a spool surface and being rotatably mounted to the base, the spool having an axis of rotation generally perpendicular to the base, the spool configured to wind a linear material around the spool surface as the spool rotates in a first direction and to unwind the linear material from around the spool surface as the spool rotates in a second direction;

a motor configured to interact with the spool to selectively rotate the spool in the first direction or in the second direction;

control circuitry in communication with the motor, the control circuitry configured to receive at least one signal from a remote control device and output one or more control signals to cause the motor to rotate the spool in the first direction or cause the motor to rotate the spool in the second direction; and wherein, in response to a first input to wind the linear material, the control circuitry alternates between causing the motor to rotate the spool in the first direction and causing the motor to rotate the spool in the second direction.

8. The automated reel of claim 7, wherein the control circuitry is configured to receive the first input from a user to begin winding the linear material.

9. The automated reel of claim 7, wherein the control circuitry is configured to detect a physical strike from a user as the first input.

10. The automated reel of claim 7, wherein the control circuitry is configured to output at least one signal to the remote control device.

11. The automated reel of claim 7, wherein the control circuitry is configured to detect when substantially all the linear material is wound around the spool.

12. The automated reel of claim 7, wherein the linear material is a woven jacket hose.

13. The automated reel of claim 7, wherein the spool is further configured to provide power assisted unwinding of the linear material.

14. The automated reel of claim 7 and further comprising a cover substantially surrounding the spool and having an eyelet therein to allow the linear material to pass therethrough.

15. The automated reel of claim 14 and further comprising one or more sensors configured to detect rotation of the cover relative to the base.

16. The automated reel of claim 14 and further comprising one or more sensors configured to detect rotation of the cover relative to the spool.

17. The automated reel of claim 16, wherein the control circuitry is configured to cause the motor to cease winding the linear material in response to a detection that the cover is not rotating relative to the spool.

18. The automated reel of claim 7, wherein the control circuitry is configured to obtain a motor signal indicative of a torque that is exerted upon the spool and not produced by the motor.

19. The automated reel of claim 7, wherein the control circuitry is configured to detect movement of the base and send a signal to cause the motor to rotate in the second direction to provide power assisted unwinding of the linear material.

20. A method of providing a motorized reel for spooling linear material, the method comprising:

providing a spool having a vertical axis of rotation, the spool configured to rotate in a first direction to wind a linear material around the spool and rotate in a second direction to unwind the linear material from around the spool;

providing a motor configured to interact with the spool to control a direction of rotation of the spool;

providing a motor controller configured to receive an input from a remote control device to begin winding the linear material and, in response, outputting a first control signal to cause the motor to rotate the spool in the first direction a first distance to wind the linear material followed by a second control signal to cause the motor to rotate the spool in the second direction a second distance to loosen the linear material from around the spool; and wherein the first distance is greater than the second distance.

* * * * *